United States Patent [19]

Bell et al.

[11] 4,104,747

[45] Aug. 8, 1978

[54] CONVERTIBLE SOFA AND BED STRUCTURE

[75] Inventors: Richard A. Bell; Earl C. Wallace; Ted W. Winters, all of Andrews, Ind.

[73] Assignee: General Engineering and Mfg. Corporation, Andrews, Ind.

[21] Appl. No.: 787,447

[22] Filed: Apr. 14, 1977

[51] Int. Cl.[2] ..... D47C 17/17

[52] U.S. Cl. ..... 5/37 R; 5/30; 5/47

[58] Field of Search ..... 5/13, 30, 37 R, 47, 5/58; 297/318, 342

[56] References Cited

U.S. PATENT DOCUMENTS

| | | | |
|---|---|---|---|
| 2,939,156 | 6/1960 | Fox | 5/37 R |
| 3,857,121 | 12/1974 | Rogers, Jr. | 5/37 R |
| 3,913,152 | 10/1975 | Quakenbush | 5/37 R |
| 4,001,901 | 1/1977 | Quakenbush | 5/37 R |

*Primary Examiner*—Casmir A. Nunberg
*Attorney, Agent, or Firm*—Donald R. Fraser

[57] ABSTRACT

A convertible sofa and bed structure comprising a pair of pivotally interconnected frame members. One of the frame members is utilized as a backrest and the other as a seatrest in the seating or sofa position; and both are moveable to aligned horizontal positions in the bed position. An important feature of the structure resides in the fact that operating linkages are positioned outwardly of a zone beneath the frame member which functions as a seatrest. Thereby, the defined zone will provide an unobstructed storage compartment.

5 Claims, 5 Drawing Figures

CONVERTIBLE SOFA AND BED STRUCTURE

FIELD OF THE INVENTION

This invention relates to a convertible sofa and bed apparatus which is readily moveable from a seating position where the backrest extends upright from the seat into a bed position wherein the backrest extends in a horizontal plane coplanar with the seat. Such structures have been found to be particularly adaptable to recreational type vehicles where space is typical at a premium.

BACKGROUND OF THE INVENTION

The acceptance by the public of the recreational vehicle as a mobile facility for daytime living and nighttime lodging has given rise to numerous approaches to the accommodation of human beings whether seated or recumbent. Much effort has been devoted to the achievement of compact arrangements employing seating facilities that are convertible to sleeping accommodations. Storage, manifestly has become a serious consideration from the designer's, as well as the purchaser's and user's standpoint. The achievement of compactness makes recreational vehicles available to families of modest means. Even in the more spacious vehicles in the luxury class, compactness, storage, and convertibility of seating and sleeping arrangements make space available for the accommodation of furniture generally found and enjoyed in the home but not classified as essential to life in a recreational vehicle.

SUMMARY OF THE INVENTION

The objectives of the invention include the provision of a convertible sofa and bed structure which may be economically manufactured and utilized where space is at a premium.

Another object of the invention is the provision of a convertible sofa and bed structure wherein the force utilized to effect a conversion of the structure is typically applied to the structure through the back frame member.

Another object of the invention is the provision of a convertible sofa and bed structure wherein the seat framework is at all times capable of being swung upwardly to expose a storage compartment therebeneath.

Still another object of the invention is the provision of a convertible sofa and bed structure wherein the supporting linkage elements may be readily disposed inwardly of the side ends of the structure to enable the same to be employed in a recreational vehicle between the rear wheel well protrusions, for example.

BRIEF DESCRIPTION OF THE DRAWINGS

A complete understanding of the invention may be had by one skilled in the art from reading the following detailed description of an embodiment of the invention when considered in the light of the accompanying drawings in which:

FIG. 5 is a fragmentary perspective view similar to the structure illustrated in FIG. 1 wherein the base frame and associated moving parts are mounted inboard to accommodate wheel wells, heaters, water tanks and the like.

DETAILED DESCRIPTION OF AN EMBODIMENT OF THE INVENTION

Figure 1:
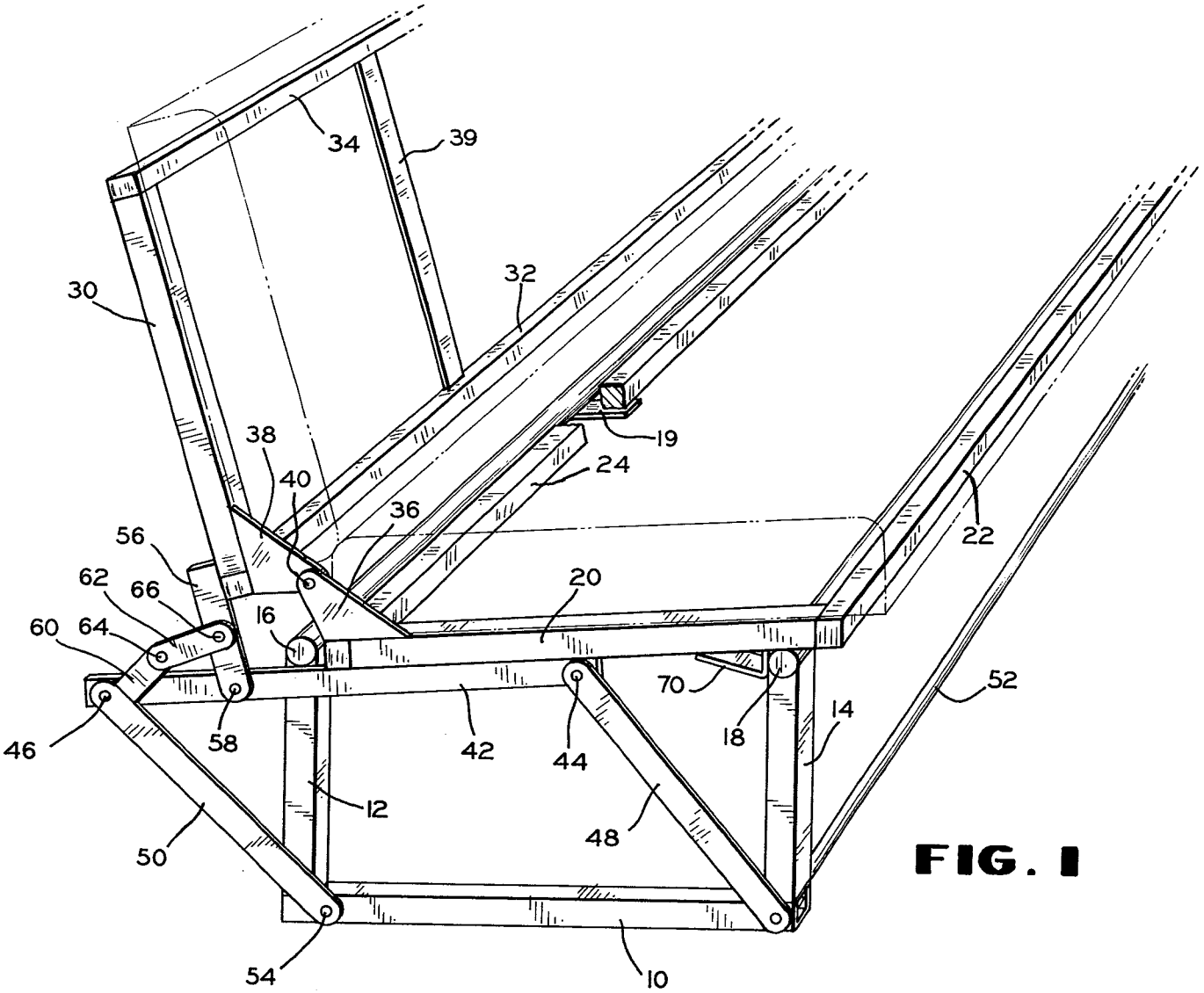
FIG. 1 is a fragmentary perspective view of a convertible sofa and bed structure with parts broken away to more clearly illustrate the structure.

Referring to the drawings, there is shown a convertible sofa and bed structure for use in a recreational vehicle, for example. The illustrated structure includes a base frame having a generally horizontally disposed floor engaging member 10 which may be satisfactorily formed of tubular metal stock of a rectangular cross-section, for example. The base frame further includes a pair of upstanding, spaced-apart members 12 and 14 which may be welded, for example, to opposite end portions of the floor engaging member 10. While only a single side of the entire operative structure is shown, it will be understood that each side of the completed structure incorporates substantially identical frame and linkage elements. However, for the sake of clarity only a single side will be explained in detail. In this regard, it will be noted that the base frame, including members 10, 12, and 14, is typically coupled to an opposite base frame assembly by means of a pair of horizontally extending, spaced-apart, tubular stock members 16 and 18. The tubular stock illustrated for members 16 and 18 is shown as being circular in cross-section, it being understood that other cross-sectional configurations will function as well. The members 16 and 18 have their respective end portions welded, for example, to the upper end portions of the upstanding members 12 and 14, respectively. Further, the base frame includes a stop bracket 19 which is typically secured, as by welding, to the member 16 and extends generally perpendicularly therefrom in a horizontal plane.

The seat frame structure illustrated is generally rectangular in overall shape and includes a side element 20, a front element 22, and a rear element 24 all formed of a tubular metal stock being welded or otherwise suitable joined at their abutting end portions. The tubular stock making up the seat frame is illustrated as being rectangular in cross-section; however, other cross-sectional configurations may likewise be utilized.

The back frame structure illustrated is generally rectangular in overall shape and includes a side element 30, a lower element 32, and an upper element 34, all formed of a tubular metal stock as is used in the seat frame structure. Further, the back frame structure includes a spacer bar member 39 which typically spans the space between the lower and upper elements 32 and 34 respectively and extends in parallel relation to the side elements 30. The opposite ends of the spacer bar 39 are suitably secured, as by welding, to the lower and upper elements 32 and 34.

The seat frame and the back frame are pivotally interconnected by means of a pair of pivot hinges 36 and 38 suitably secured to the side elements 20 and 30 of the seat and back frame, respectively. The pivot hinges 36 and 38 pivotally interconnected by a pivot pin 40 at points spaced from the planes of the frames.

A carrier bar 42 has its opposite ends pivotally attached, as by pivot pins 44 and 46, to the upper ends of a pair of spaced apart level arms 48 and 50, respectively. The lower ends of the lever arms 48 and 50 are pivotally attached to the floor engaging member 10 of the base frame. The front lever arm 48 tightly secured to the end of a torque rod 52 which is adapted to be rotatably received within suitably aligned apertures in the lower portion of the upstanding member 14. The torque rod 52 is adapted to extend horizontally between the spaced apart side frames and has its opposite end portions fixedly secured to the lever arm 48 and the corresponding lever arm, not shown, associated with the other side frame. The rear lever arm 50 is pivotally connected to the floor engaging member 10 of the base frame by a pivot pin 54.

The back frame is pivotally connected to the carrier bar 42 through a fulcrum extension 56. The distal end portion of the fulcrum extension 56 is pivotally connected to the carrier bar 42 by a pivot pin 58 disposed intermediate the ends of the bar, while the opposite end of the extension 56 is suitably affixed to the back frame in the region of the juncture of the side element 30 and the lower element 32.

The rear lever arm 50 is provided with a crank extension 60 which is coupled to the back frame through the fulcrum extension 56 thereof by a drag link 62. One end of the drag link 62 is pivotally connected to the crank extension 60 by a pivot pin 64, while the opposite end of the drag link 62 is pivotally connected to the back extension 56 by a pivot pin 66.

Figure 2:
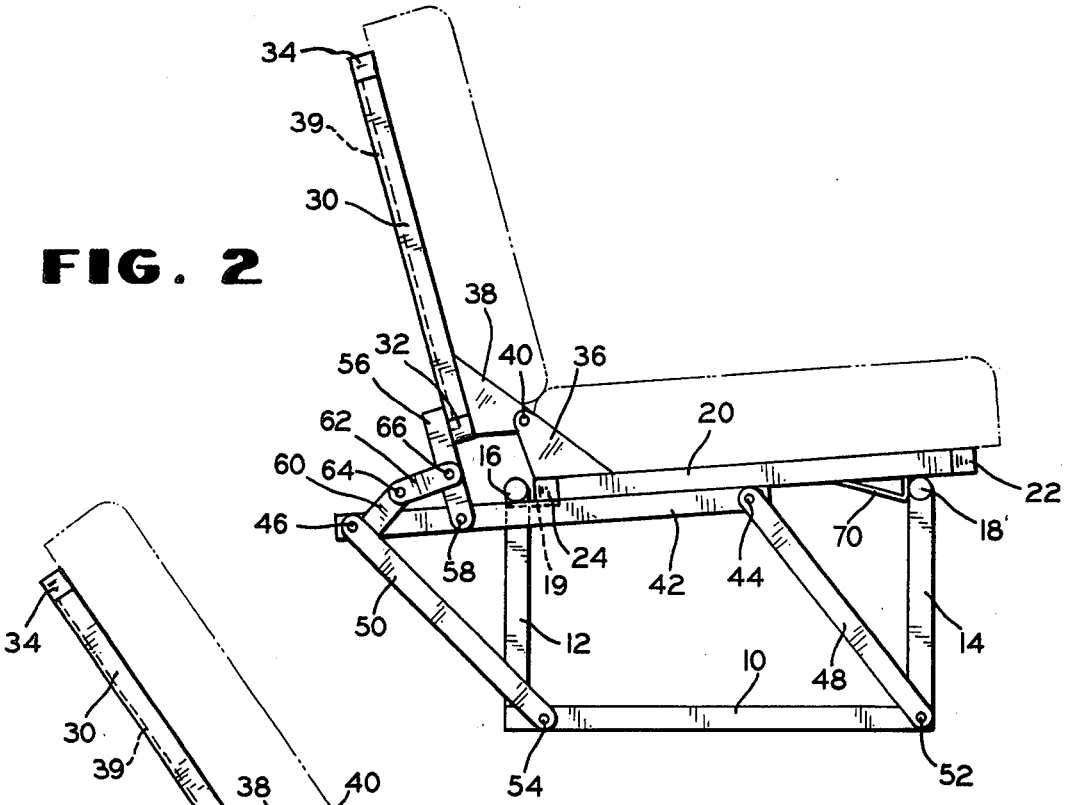
FIG. 2 is an end view of the structure illustrated in FIG. 1 showing the structure in a seating or sofa position.
Figure 3:
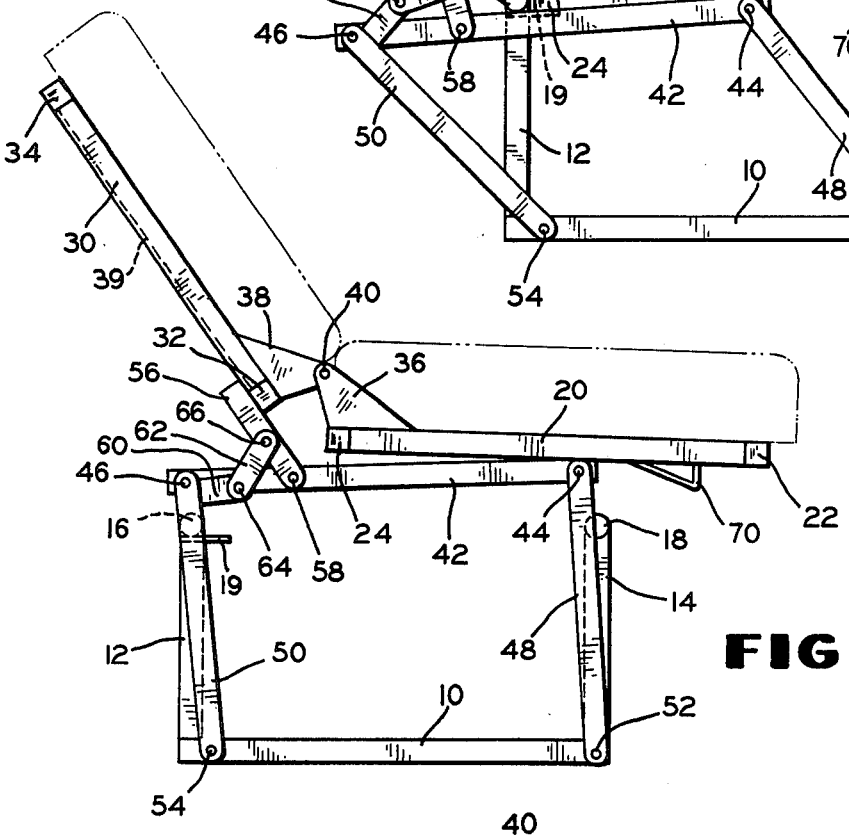
FIG. 3 is an end view of the structure illustrated in FIGS. 1 and 2 showing the structure in an intermediate position between the full seating position of FIGS. 1 and 2 and the full horizontal or sofa position illustrated in FIG. 4.
Figure 4:
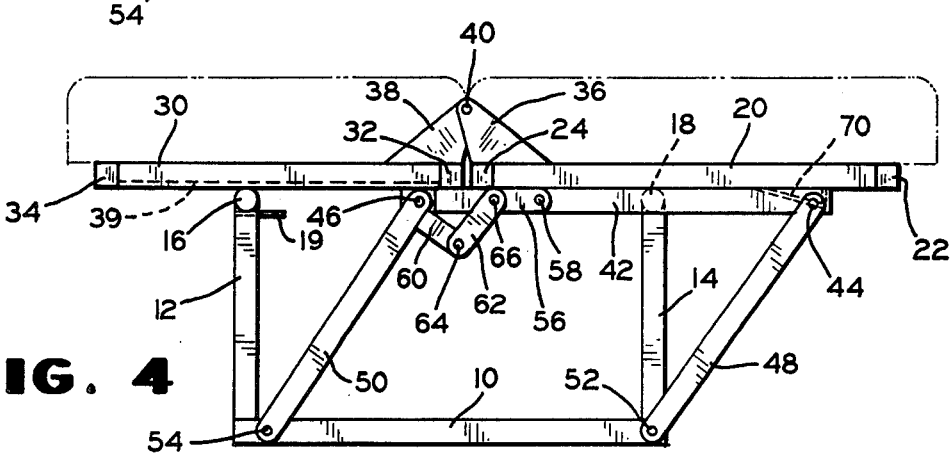
FIG. 4 is an end view of the structure illustrated in FIGS. 1, 2, and 3 showing the structure in a full horizontal or bed position.

As will be apparent from an examination of FIGS. 2, 3, and 4, the seat frame and the back frame are typically provided with suitable upholstery as illustrated generally by phantom lines. It will be further observed by following the linkage movement as the entire assembly is converted from a seat or sofa configuration of FIG. 2 to a bed configuration of FIG. 4, the fact that the pivot hinges 36 and 38 established a pivot point positioned away from the base of the upholstery allows the various linkage movements to occur without pinching, crushing or otherwise adversely distorting the configurations of the upholstery of the seat and back portions.

Figure 5:
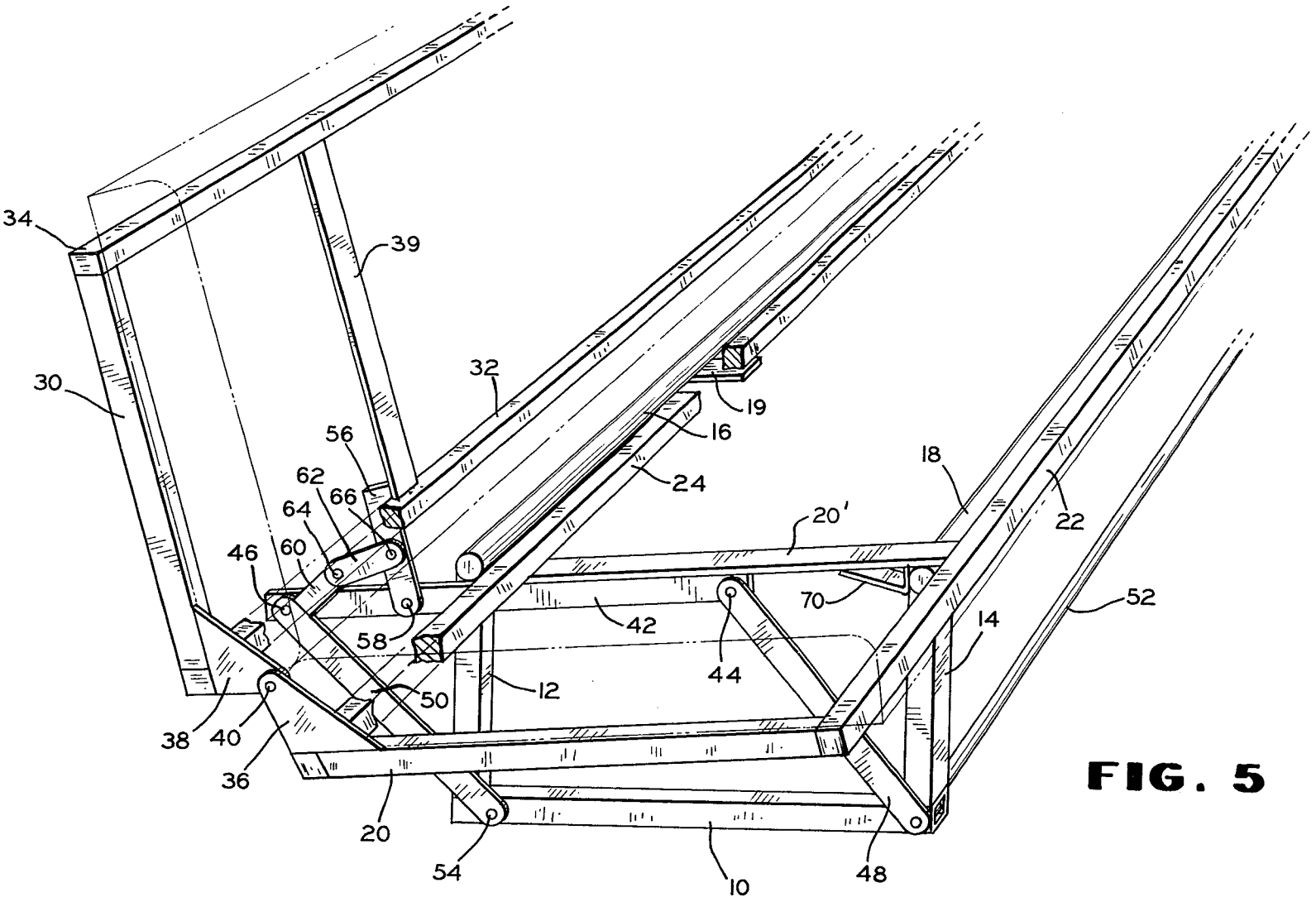

In order to effectively latch the seat frame to the base frame during the seating or sofa configuration of the structure, latch means 70 are affixed to the lower surface of the side member 20 of the seat frame in the embodiment illustrated in FIGS. 1, 2, 3, and 4, and the lower surface of a spacer bar 20' in the embodiment illustrated in FIG. 5, and abut against the inner surface of the member 18 of the base frame. The latch means 70 effectively latch the entire mechanism against collapsing should the attendant vehicle be impacted from the rear.

In operation, FIGS. 2, 3, and 4 illustrate the manner in which the various linkage elements are relatively positioned during the change from the seating or sofa configuration (FIG. 2) to the full bed configuration (FIG. 4).

More specifically, the seat portion is initially lifted, typically by grasping the front element 22 of the seat frame and then pulling the same forwardly along a generally horizontal path. Such movement will simultaneously cause the carrier bar 42 to move forwardly and upwardly and thereby, simultaneously cause the lever arms 48 and 50 to rotate about their respective pivot points 52 and 54. The pivot point 52 is in effect the torsion bar which is coupled to a similar lever arm on the opposite side of the structure and effectively maintains the same angular alignment between the corresponding lever arms. As the lever arm 50 is swung about its pivot point 54, the crank arm 60 affixed thereto will effect a swinging or rotational movement of the back frame about its pivot point 58 on the carrier bar 42 through the pivotal connection of the drag link 62. FIG. 3 illustrates the linkage structure wherein the lever arms 48 and 50 and the associated carrier bar 42 are at their highest arcuate paths of travel and just prior to commencing a travel through the downward portion of the arc to the position illustrated in FIG. 4. FIG. 4 illustrates the structure in a position wherein the back frame and the seat frame are in horizontal alignment to define a bed. It will be observed that as the linkage and frame elements traverse from a seating configuration illustrated in FIG. 2 to the bed position illustrated in FIG. 4, the offset pivotal relationship therebetween effected by the pivot hinges 36 and 38 is accomplished without distortion of the upholstery and associated cushioning means.

It will be further appreciated that during any relative position of the seat frame it may be rocked upwardly about the pivot point 40 of the pivot hinges 36 and 38 to, in effect, make available the zone therebeneath which is typically utilized for storage purposes. Also, due to the unique linkage configuration, the transposition from the seating position of FIG. 2 to the full bed position of FIG. 4 is accomplished without materially decreasing the zone defined under the seat. Therefore, the zone provides a substantial compartment for storage. Further, as is clearly apparent from the drawings, when the frames and linkages are in the sofa or seating configuration (FIGS. 1, 2, and 5), the seat frame is supported by the front portion of the side element 20 resting against the upper surface of the front member 18 of the base frame, while the rear member 24 of the seat frame rests against the upper surface of the stop bracket 19. In the bed configuration, the seat frame has been moved forwardly to a position where the center portion of the side member 20 of the seat frame is supported by the base frame member 18, and the back frame has been rocked to a horizontal position wherein the back surface of the spacing bar 39 is supported on the base frame member 16.

FIG. 5 shows an alternative embodiment of the structure illustrated in FIGS. 1 to 4, wherein the mechanism is substantially identical but is moved inwardly so that the base frame may be of any size, centralized, or off-set to accommodate such structural components of the associated vehicle as wheel wells, heaters, water tanks, and the like.

What is claimed is:

1. A convertible seat and sofa structure comprising:

a base frame;

a seat frame;

a back frame;

hinge means pivotally interconnecting said seat and back frames;

a carrier bar;

a pair of lever arms;

means pivotally securing one end of each of said lever arms to said base frame;

means pivotally securing the opposite end of each of said lever arms to said carrier bar so as to cause said carrier bar to extend for and aft with respect to said seat frame when said seat frame is in a horizontal position;

a crank arm affixed to the opposite end of one of said lever arms;

means pivotally securing said back frame to said carrier bar;

a drag link; and means pivotally securing one end of said drag link to said crank arm at a point spaced from said lever arm and the other end of said drag link to said back frame, whereby when said carrier bar is moved to a forward position said crank arm forces said back frame to pivot about the pivotal connection between said back frame and said carrier bar to move said back frame to a horizontal position in alignment with said seat frame.

2. A convertible seat and sofa structure comprising:

a base frame;

a generally horizontally extending carrier bar;

a pair of spaced apart lever arms having one of their ends pivotally connected at spaced points to said base frame and having the opposite ends pivotally connected at spaced points to said carrier bar;

a seat frame;

a back frame;

hinge means for pivotally interconnecting said seat and back frames;

means for pivotally attaching said back frame to said carrier bar;

a drag link; and, a crank arm having one end affixed to one of said lever arms and the other end pivotally coupled to said back frame through said drag link whereby when said carrier bar is moved to a forward position said crank arm forces said back frame to pivot about said pivotal connection between said back frame and said carrier bar to move to a horizontal position in alignment with said seat frame.

3. The invention defined in claim 2 wherein said means for pivotally attaching said back frame to said carrier bar includes an extension arm having one end secured to said back frame and the other end extending outwardly away from said back frame, means pivotally securing the other end of said extension arm to said carrier bar intermediate the pivot connections of said lever arms.

4. The invention defined in claim 2 wherein the pivotal connection of said hinge means for said seat and back frames is disposed radially inwardly from said frames.

5. The invention defined in claim 2 wherein at least one of said one ends of said lever arms is coupled to a similar lever arm of a cooperating structure at the opposite side of the convertible seat and sofa structure through a torsion bar to maintain alignment of said lever arms having movement thereof.

* * * * *